US009596965B2

(12) United States Patent
Sundberg et al.

(10) Patent No.: US 9,596,965 B2
(45) Date of Patent: Mar. 21, 2017

(54) POTTY WITH LIQUID MANAGEMENT SYSTEM

(71) Applicant: DOREL JUVENILE GROUP, INC., Foxboro, MA (US)

(72) Inventors: Brian C Sundberg, Chester, NH (US); Joseph D Langley, Foxboro, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 216 days.

(21) Appl. No.: 14/193,352

(22) Filed: Feb. 28, 2014

(65) Prior Publication Data

US 2014/0259354 A1 Sep. 18, 2014

Related U.S. Application Data

(60) Provisional application No. 61/785,954, filed on Mar. 14, 2013.

(51) Int. Cl.

| | |
|---|---|
| ***A47K 11/04*** | (2006.01) |
| ***A47K 11/06*** | (2006.01) |
| ***A47K 13/00*** | (2006.01) |

(52) U.S. Cl.

CPC ..... *A47K 11/04* (2013.01); *A47K 11/06* (2013.01); *A47K 13/00* (2013.01)

(58) Field of Classification Search

CPC ..... A47K 11/04; A47K 11/00; A47K 11/06; A47K 13/00; Y10S 4/902; G09B 19/0076

USPC ..... 4/483, 235, 449, 476

See application file for complete search history.

(56) References Cited

U.S. PATENT DOCUMENTS

| | | | | | |
|---|---|---|---|---|---|
| 612,076 | A | * | 10/1898 | Weston | A47K 11/04 4/239 |
| 2,974,321 | A | | 3/1961 | Salka | |
| 3,142,847 | A | | 8/1964 | Kurrels | |
| 3,343,179 | A | * | 9/1967 | Sellars, Jr. | A47K 13/06 4/239 |
| RE26,520 | E | * | 1/1969 | Sellars | A47K 13/06 4/239 |
| 3,501,781 | A | * | 3/1970 | Ott | A61B 10/007 4/450 |
| 4,161,793 | A | * | 7/1979 | Merchan | A47K 10/38 4/449 |
| 4,461,046 | A | * | 7/1984 | Adams | A47K 13/06 4/235 |
| 5,161,263 | A | * | 11/1992 | Geneve | A47K 11/06 4/239 |
| D379,495 | S | | 5/1997 | Sidman et al. | |
| D381,070 | S | | 7/1997 | Deniakis et al. | |
| 5,974,598 | A | * | 11/1999 | Granda-Cabrera | A47K 11/02 4/239 |
| D454,624 | S | | 3/2002 | Yeung | |
| 6,385,790 | B1 | | 5/2002 | Abraham et al. | |
| 7,150,050 | B2 | | 12/2006 | Sharp | |
| 7,770,242 | B2 | | 8/2010 | Sell | |
| 2003/0217409 | A1 | * | 11/2003 | Catanescu | A47K 11/04 4/484 |
| 2008/0086804 | A1 | | 4/2008 | Goh Aow | |

(Continued)

*Primary Examiner* — J. Casimer Jacyna
*Assistant Examiner* — Benjamin R Shaw
(74) *Attorney, Agent, or Firm* — Barnes & Thornburg LLP

(57) ABSTRACT

A potty for use by young children includes a waste collector and a seat adapted to rest on the waste collector. The potty can be placed in an aperture formed in a base.

11 Claims, 4 Drawing Sheets

(56) References Cited

U.S. PATENT DOCUMENTS

| | | | | |
|---|---|---|---|---|
| 2008/0263756 | A1* | 10/2008 | Marsden | A47K 11/06 4/239 |
| 2010/0043132 | A1* | 2/2010 | Viglietta | A47K 11/06 4/483 |
| 2011/0030134 | A1* | 2/2011 | Dubiel | A47K 11/06 4/483 |
| 2011/0061157 | A1* | 3/2011 | Goergen | A47K 11/06 4/483 |
| 2011/0131718 | A1 | 6/2011 | Smimth | |
| 2011/0314598 | A1 | 12/2011 | Rathbone | |
| 2012/0084909 | A1* | 4/2012 | Dunn | A47K 11/06 4/483 |

* cited by examiner

POTTY WITH LIQUID MANAGEMENT SYSTEM

PRIORITY CLAIM

This application claims priority under 35 U.S.C. §119(e) to U.S. Provisional Application Ser. No. 61/785,954, filed Mar. 14, 2013, which is expressly incorporated by reference herein.

BACKGROUND

The present disclosure relates to a juvenile potty system. In particular, the present disclosure relates to a child training potty for use by itself or in combination with an adult toilet.

SUMMARY

A juvenile potty system in accordance with the present disclosure includes a seat, a waste-collection bowl associated with the seat, and a base configured to receive the waste-collection bowl and the seat. In illustrative embodiments, a mobile child potty includes a waste-collection bowl, a juvenile trainer seat configured to lie on top of the waste-collection bowl, and a seat topper configured to lie on top of the juvenile trainer seat. The seat topper is also configured to be removed from the juvenile trainer seat and placed on an adult toilet seat.

In illustrative embodiments, a downwardly extending liquid-deflection rim of the juvenile trainer seat is arranged to extend into an interior region of the waste-collection bowl to overlap and lie within a brim of the waste-collection bowl to deflect discharged liquid into the waste-collection bowl. A downwardly extending liquid-deflection rim of the seat topper is arranged to extend into the interior region of the waste-collection bowl to overlap and lie within the liquid-defection rim of the juvenile trainer seat and the brim of the waste-collection bowl to deflect discharged liquid into the waste-collection bowl.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
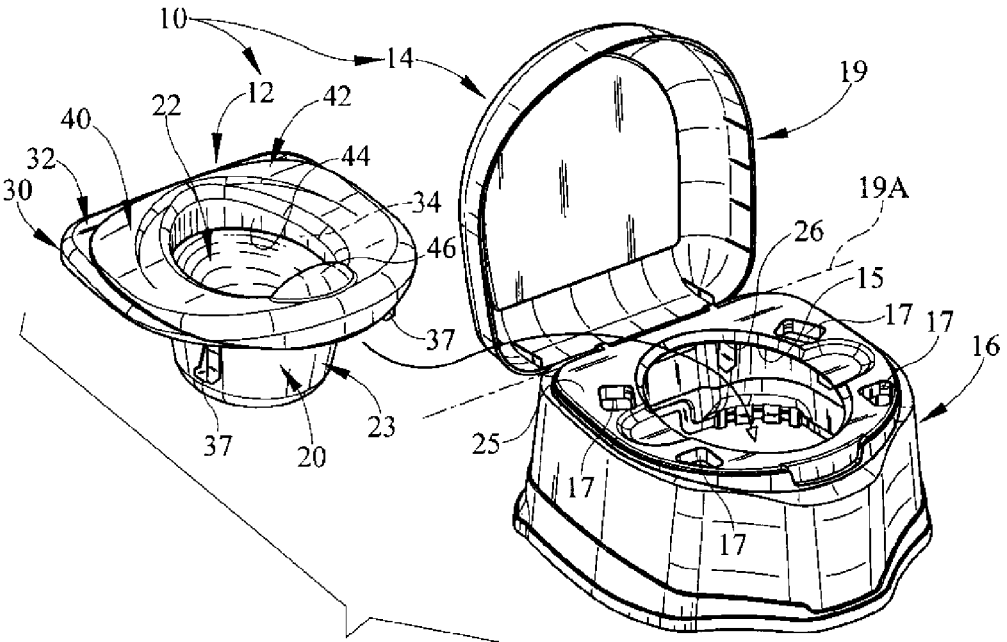
FIG. 1 is a perspective view of a juvenile potty system in accordance with the present disclosure and showing that the system includes a removable waste collector comprising a ring-shaped seat topper adapted to be used on an adult toilet as suggested in FIG. 2, a ring-shaped juvenile trainer seat underlying the seat topper, and a waste-collection bowl underlying the juvenile trainer seat and showing that the system also includes a footstool including a base formed to mate with and support the removable waste collector in a use position as shown, for example, in FIGS. 4 and 5 and a lid mounted on the base for movement between an opened position shown in FIG. 1 and a closed position shown in FIG. 2.
Figure 2:
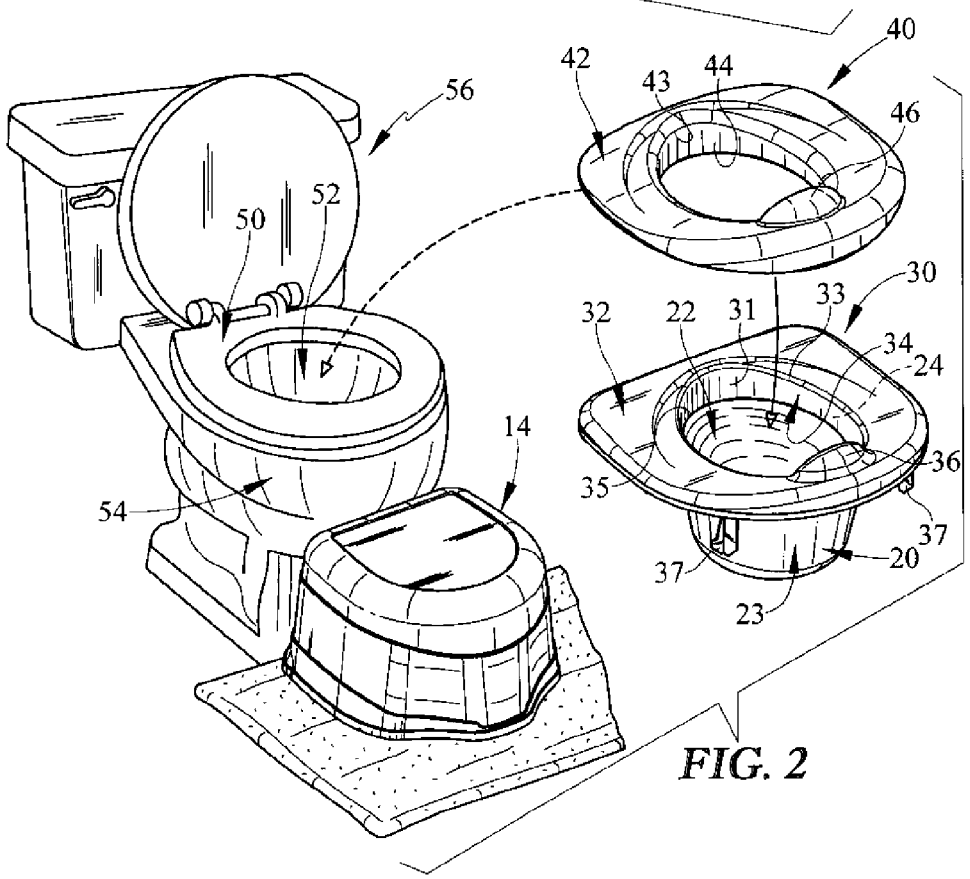
FIG. 2 is a perspective view of the removable waste collector of FIG. 1 showing that the ring-shaped seat topper has been separated from the underlying ring-shaped juvenile trainer seat so that it can be placed on a seat of an adult toilet and showing that the footstool can be placed alongside a front portion of the adult toilet (once the lid has been moved relative to the base to assume the closed position) to locate an elevated step surface provided on a top wall of the lid near the adult toilet to provide means for helping a young child climb onto the ring-shaped seat topper after it has been placed on the seat of the adult toilet.
Figure 6A:
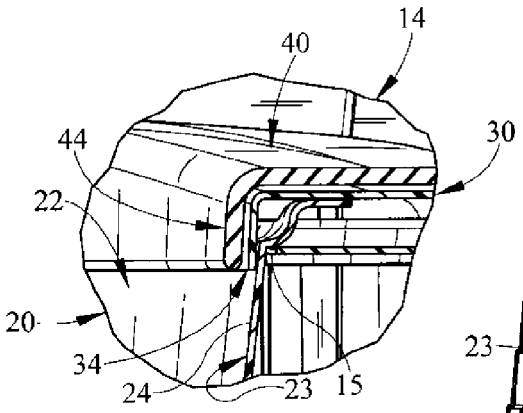
FIG. 6A is an enlarged view of the circled region of FIG. 6 showing that the seat topper includes a liquid-deflection rim that overlaps with and extends inside the brim of the waste-collection bowl, and showing that the juvenile trainer seat underlying the seat topper also includes a liquid-deflection rim that overlaps with and extends inside the brim of the waste-collection bowl and lies in an annular space provided between the liquid-deflection rim of the seat topper and the brim of the waste-collection bowl.
Figure 9A:
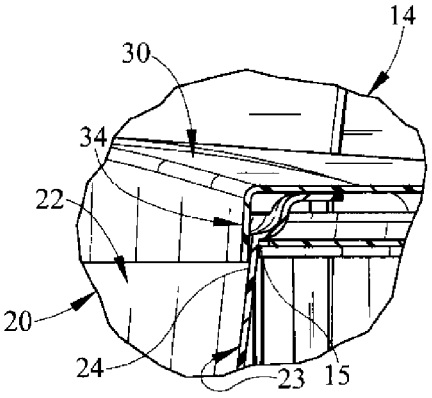
FIG. 9A is an enlarged view of the circled region of FIG. 9 showing that the juvenile trainer seat includes a liquid-deflection rim that overlaps with and extends inside the brim of the waste-collection bowl.
Figure 9:
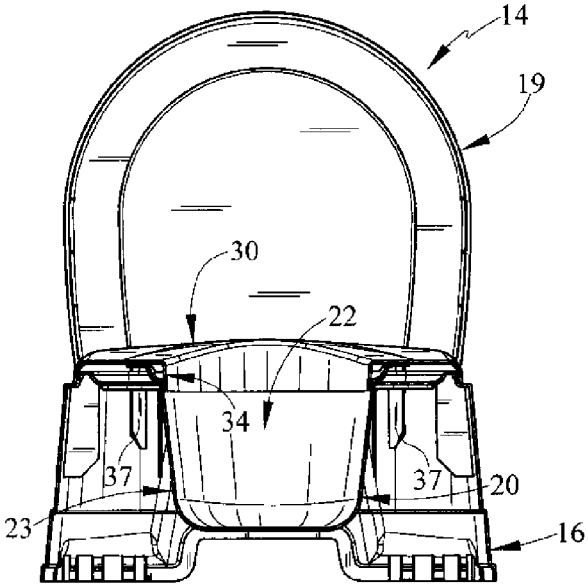
FIG. 9 is a sectional view taken along line 9-9 of FIG. 4 suggesting that the liquid-deflection rim of the juvenile trainer seat extends downwardly into the interior region of the waste-collection bowl to deflect discharged liquid into the bowl without allowing such liquid to escape to a region under the juvenile trainer seat and outside the waste-collection bowl.

A juvenile potty system 10 includes a mobile child potty 12 and a separate footstool 14 shown, for example, in FIGS. 1 and 2. Mobile child potty 12 includes a waste-collection bowl 20, a juvenile trainer seat 30 configured to lie on top of waste-collection bowl 20, and a seat topper 40 configured to lie on top of juvenile trainer seat 30 as suggested in FIGS. 1-3. Seat topper 40 can be removed from juvenile trainer seat 30 and placed on an adult toilet seat 50 as suggested in FIG. 2. A downwardly extending liquid-deflection rim 34 of juvenile trainer seat 30 is arranged to extend into an interior region 22 of waste-collection bowl 20 to overlap and lie within a brim 24 of waste-collection bowl 20 to deflect liquid into waste-collection bowl 20 as suggested in FIGS. 6 and 6A. A downwardly extending liquid-deflection rim 44 of seat topper 40 is arranged to extend into interior region of waste-collection bowl 20 to overlap and lie within liquid-deflection rim 34 of juvenile trainer seat 30 and brim 24 of waste-collection bowl 20 as suggested in FIGS. 9 and 9A.

Figure 3:
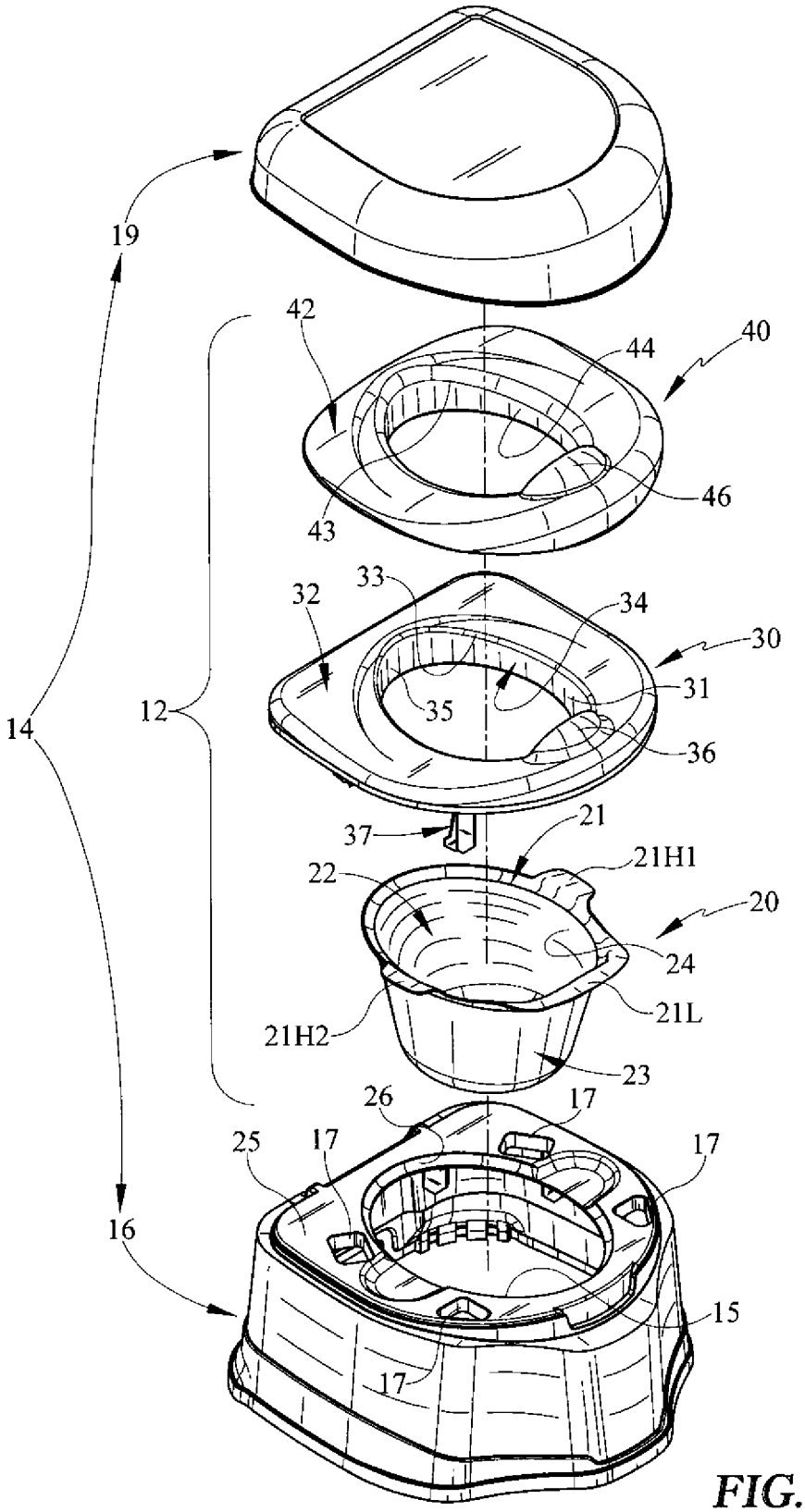
FIG. 3 is an exploded perspective assembly view of the juvenile potty system of FIG. 1 showing, in series, from top to bottom, the lid of the footstool, the removable waste collector comprising a seat topper including a seat pad and an inner liquid-deflection rim, a juvenile trainer seat including a seat pad and an inner liquid-deflection rim, and a waste-collection bowl, and the base of the footstool.
Figure 4:
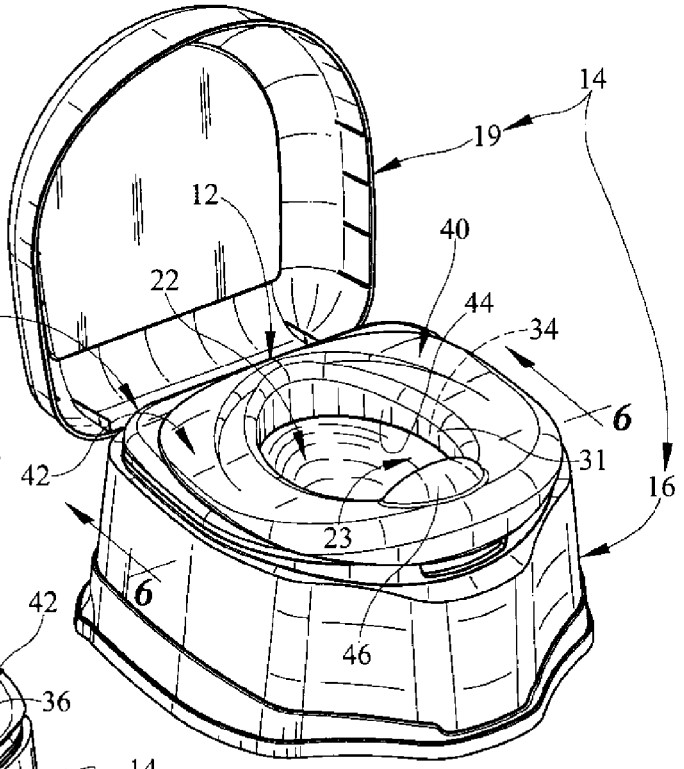
FIG. 4 is a front perspective view of a juvenile potty system in accordance with the present disclosure showing the seat topper positioned to lie on the juvenile trainer seat supported above the waste-collection bowl to cause the liquid-deflection rim of the seat topper to extend downwardly into an interior region of the waste-collection bowl.
Figure 5:
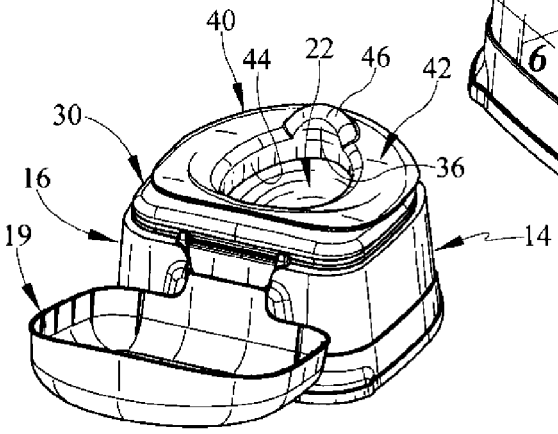
FIG. 5 is a rear perspective view of the juvenile potty system of FIG. 4.
Figure 6:
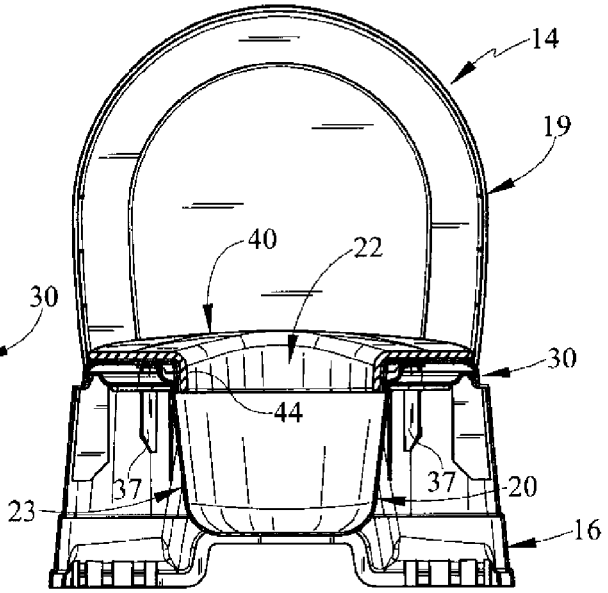
FIG. 6 is a sectional view taken along line 6-6 of FIG. 4 suggesting that the liquid-deflection rim of the seat topper extends downwardly into the interior region of the waste-collection bowl to deflect discharged liquid into the bowl without allowing such liquid to escape to a region under the seat topper and outside the waste-collection bowl.
Figure 7:
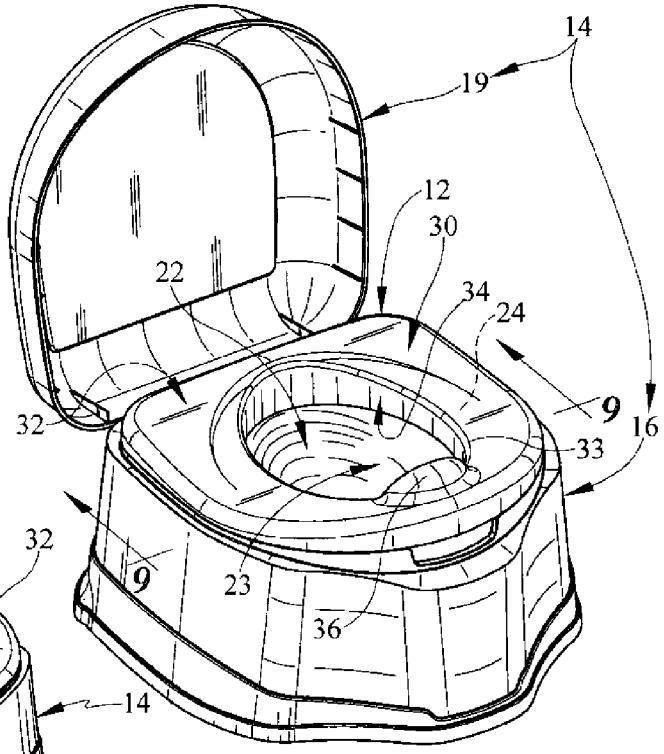
FIG. 7 is a front perspective view of a juvenile potty system in accordance with the present disclosure after the seat topper has been removed and showing the juvenile trainer seat supported above the waste-collection bowl to cause the liquid-deflection rim of the juvenile trainer seat to extend downwardly into an interior region of the waste-collection bowl.
Figure 8:
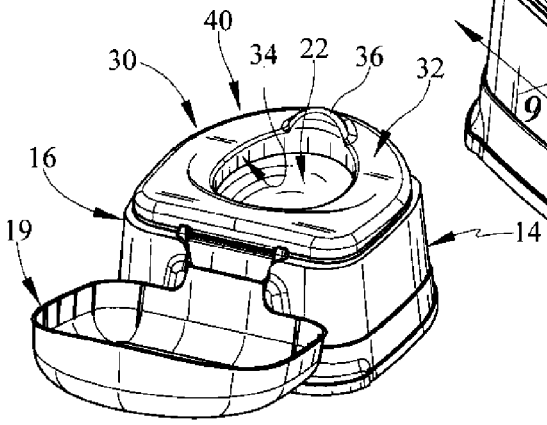
FIG. 8 is a rear perspective view of the juvenile potty system of FIG. 4.

Mobile child potty 12 is configured to be mounted in an aperture 15 formed in a base 16 of footstool 14 after a lid 19 has been moved about a lid-pivot axis 19A to an opened position as suggested in FIG. 1 and shown in FIGS. 4-6. Mobile child potty 12 is mounted on base 16 of footstool 14 by, in sequence, placing waste-collection bowl 20 on base 16 to extend through aperture 15, placing juvenile trainer seat 30 on top of waste-collection bowl 20, and then (if desired) placing seat topper 40 on top of juvenile trainer seat 30 as suggested in FIG. 3. Child potty 12 is also suitable for use in another piece of furniture that includes a base and perhaps a lid but does not function as a footstool.

Waste-collection bowl 20 includes an annular seat receiver 21 comprising a lip 21L and two separate handles 21H1, 21H2 coupled to lip 21L and arranged to extend in opposite directions as suggested in FIG. 3. Waste-collection bowl 20 also includes a waste receptacle 23 formed to include interior region 22. Brim 24 of waste-collection bowl 20 is provided by an upper portion of waste receptacle 23 located alongside annular seat receiver 21. Waste generated by children seated on seat topper 40 or juvenile trainer seat 30 of mobile child potty 12 is collected in interior region 22 of waste receptacle 23. Lip 21L of annular seat receiver 21 is tapered as suggested in FIG. 3 down into waste receptacle 23 to force any excess liquid splatter to run back into interior region 22 of waste receptacle 23.

Juvenile trainer seat 30 includes a seat pad 32 formed to include an interior edge 33 and an annular downwardly extending liquid-deflection rim 34 coupled to seat pad 32 at interior edge 33 as suggested in FIG. 3. Juvenile trainer seat 30 also includes a urine deflector 36 coupled to seat pad 32. In use, liquid-deflection rim 34 of juvenile trainer seat 30 is arranged to extend into interior region 22 of waste-collection bowl 20 to deflect discharged liquid into waste receptacle 23 without allowing such liquid to escape to a region under juvenile trainer seat 30 and outside of bowl 20 as suggested in FIGS. 9 and 9A. Liquid-deflection rim 34 functions as a retaining wall to contain discharged liquid and minimize leakage.

Seat topper 40 includes a seat pad 42 formed to include an interior edge 43 and an annular downwardly extending liquid-deflection rim 44 coupled to seat pad 42 at interior edge 43 as suggested in FIG. 3. Seat topper 40 also includes a urine deflector 46 coupled to seat pad 42. In use, liquid-deflection rim 44 of seat topper 40 is arranged to extend into interior region 22 of waste-collection bowl 20 to deflect discharge liquid from a child seated on seat pad 42 into waste receptacle 23 without allowing such liquid to escape to a region under seat topper 40 and outside of waste-collection bowl 20 as suggested in FIGS. 6 and 6A. Liquid-deflection rim 44 functions as a retaining wall to contain discharged liquid and minimize leakage. Seat pad 42 is made of a pliant cushion material in an illustrative embodiment.

In illustrative embodiments, juvenile trainer seat 30 further includes positioning arms 37 that are coupled to and extend below seat pad 32 to align with and extend into companion arm-receiver holes 17 formed in base 16 when juvenile trainer seat 30 is mounted on base 16 of footstool 14 as suggested in FIGS. 1, 3, 6, and 9. Trainer seat 30 hinges about a point at the back of the seat to move the seat from a use position aligned on base 16 to a non-use position tilted up from base 16. In illustrative embodiments, seat topper 40 and juvenile trainer seat 30 cooperate to provide means for supporting a child in a seated position to cause the bottom of the child to be lower than the knees of the child in a comfortable manner.

Lid 19 of footstool 14 is sized and configured to cover juvenile trainer seat 30 and seat topper 40 completely when lid 19 is closed to mate with base 16. Lid 19 may be made of a clear material so that a caregiver can see into waste-collection bowl 20 to determine if liquids are present therein.

The invention claimed is:

1. A juvenile potty system comprising a waste-collection bowl formed to include an interior region and a juvenile trainer seat including a seat pad formed to include a central aperture and a liquid deflector configured to provide an endless wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad and the liquid deflector cooperate to form a monolithic component and the waste-collection bowl includes a seat receiver having an upwardly facing surface arranged to engage a companion downwardly facing surface of the seat pad when the juvenile trainer seat is mounted to lie above the waste-collection bowl, and wherein the seat pad includes an interior edge arranged to bound the central aperture and the liquid deflector includes a downwardly extending liquid-deflection rim coupled to the seat pad at the interior edge and configured to provide the wall.

2. A juvenile potty system comprising a waste-collection bowl formed to include an interior region and a juvenile trainer seat including a seat pad formed to include a central aperture and a liquid deflector configured to provide a wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad and the liquid deflector cooperate to form a monolithic component and the waste-collection bowl includes a seat receiver having an upwardly facing surface arranged to engage a companion downwardly facing surface of the seat pad when the juvenile trainer seat is mounted to lie above the waste-collection bowl, wherein the seat pad includes an interior edge arranged to bound the central aperture and the liquid deflector includes a downwardly extending liquid-deflection rim coupled to the seat pad at the interior edge and configured to provide the wall, and wherein the waste-collection bowl includes a waste receptacle formed to include an interior region, a first handle coupled to one side of the waste receptacle, and a second handle coupled to an opposite side of the waste receptacle, the first and second handles are arranged to lie under the seat pad of the juvenile trainer seat when the juvenile trainer seat is mounted to lie above the waste collection bowl, and the downwardly extending liquid-deflection rim is arranged to extend downwardly into the interior region formed in the waste receptacle and to lie in a space provided between the first and second handles when the juvenile trainer seat is mounted to lie above the waste-collection bowl.

3. The juvenile potty system of claim 1, wherein the waste-collection bowl includes a waste receptacle formed to include the interior region and a seat receiver arranged to extend outwardly from an upper portion of the waste receptacle and to lie under the seat pad and the upper portion of the waste receptacle of the waste-collection bowl is arranged to surround the downwardly extending liquid-deflection rim of the seat pad.

4. The juvenile potty system of claim 3, wherein the seat receiver is annular and tapered downwardly in a direction toward the interior region and configured to cause any excess liquid splatter landing on the seat receiver to flow into the interior region formed in the waste receptacle.

5. A juvenile potty system comprising a waste-collection bowl formed to include an interior region and a juvenile trainer seat including a seat pad formed to include a central aperture and a liquid deflector configured to provide a wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad and the liquid deflector cooperate to form a monolithic component and the waste-collection bowl includes a seat receiver having an upwardly facing surface arranged to engage a companion downwardly facing surface of the seat pad when the juvenile trainer seat is mounted to lie above the waste-collection bowl, wherein the seat pad includes an interior edge arranged to bound the central aperture and the liquid deflector includes a downwardly extending liquid-deflection rim coupled to the seat pad at the interior edge and configured to provide the wall, wherein the waste-collection bowl includes a waste receptacle formed to include the interior region and a seat receiver arranged to extend outwardly from an upper portion of the waste receptacle and to lie under the seat pad and the upper portion of the waste receptacle of the waste-collection bowl is arranged to surround the downwardly extending liquid-deflection rim of the seat pad, wherein the seat receiver is annular and tapered downwardly in a direction toward the interior region and configured to cause any excess liquid splatter landing on the seat receiver to flow into the interior region formed in the waste receptacle, and further comprising a base formed to include an aperture, the seat receiver is arranged to mate with a portion of the base to retain the waste receptacle in a stationary position extending downwardly through the aperture, and the upper portion of the waste receptacle is arranged to lie in an annular space provided between the portion of the base and the lid-deflection rim.

6. A juvenile potty system comprising a waste-collection bowl formed to include an interior region and a juvenile trainer seat including a seat pad formed to include a central aperture and a liquid deflector configured to provide a wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad and the liquid deflector cooperate to form a monolithic component and the waste-collection bowl includes a seat receiver having an upwardly facing surface arranged to engage a companion downwardly facing surface of the seat pad when the juvenile trainer seat is mounted to lie above the waste-collection bowl, wherein the seat pad includes an interior edge arranged to bound the central aperture and the liquid deflector includes a downwardly extending liquid-deflection rim coupled to the seat pad at the interior edge and configured to provide the wall, and comprising a seat topper including a seat pad arranged to lie on top of the seat pad of the juvenile trainer seat and a downwardly extending liquid-deflection rim arranged to extend into the interior region of the waste-collection bowl to overlap and lie within the liquid-deflection rim of the juvenile trainer seat and a brim of the waste-collection bowl.

7. A juvenile potty system comprising a waste-collection bowl formed to include an interior region and a juvenile trainer seat including a seat pad formed to include a central aperture and a liquid deflector configured to provide a wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad includes an interior edge arranged to bound the central aperture and the liquid deflector includes a downwardly extending liquid-deflection rim coupled to the seat pad at the interior edge and configured to provide the wall, and further comprising a seat topper including a seat pad arranged to lie on top of the seat pad of the juvenile trainer seat and a downwardly extending liquid-deflection rim arranged to extend into the interior region of the waste-collection bowl to overlap and lie within the liquid-deflection rim of the juvenile trainer seat and a brim of the waste-collection bowl, wherein the juvenile trainer seat further includes a urine deflector coupled to the seat pad of the juvenile trainer seat and arranged to extend upwardly away from the downwardly extending liquid-deflection rim of the juvenile trainer seat, the seat topper further includes a urine deflector coupled to the seat pad of the seat topper and arranged to extend upwardly away from the downwardly extending liquid-deflection rim of the seat topper, the urine deflector of the seat topper is formed to include a downwardly opening deflector-receiving space, and the urine deflector of the juvenile seat trainer is arranged to extend upwardly into the downwardly deflector-receiving space formed in the urine deflector of the seat topper to lie in a mated, nested relation to the urine deflector of the seat topper when the seat pad of the seat topper is mounted on the seat pad of the juvenile trainer seat.

8. A juvenile potty system comprising a waste-collection bowl formed to include an interior region and a juvenile trainer seat including a seat pad formed to include a central aperture and a liquid deflector configured to provide a wall arranged to extend from the seat pad downwardly into the interior region of the waste-collection bowl when the juvenile trainer seat is mounted to lie above the waste-collection bowl and configured to provide means for deflecting body waste liquid discharged by a person seated on the seat pad through the central aperture into the interior region of the waste-collection bowl without allowing the body waste liquid to flow to a region under the seat pad and outside of the interior region of the waste-collection bowl, wherein the seat pad includes an interior edge arranged to bound the central aperture and the liquid deflector includes a downwardly extending liquid-deflection rim coupled to the seat pad at the interior edge and configured to provide the wall, and further comprising a seat topper including a seat pad arranged to lie on top of the seat pad of the juvenile trainer seat, a downwardly extending liquid-deflection rim arranged to extend into the interior region of the waste-collection bowl to overlap and lie within the liquid-deflection rim of the juvenile trainer seat and a brim of the waste-collection bowl, a footstool including a base, and a lid mounted for pivotable movement on the base about a pivot axis between a closed position covering a top wall of the base and an opened position exposing the top wall of the base, and wherein the top wall of the base includes a border edge that is formed to include a bowl-receiving aperture, the waste-receptacle bowl is mated with the base to lie in a stationary position extending downwardly through the bowl-receiving aperture, the downwardly extending liquid-deflection rim of the juvenile trainer seat is arranged to extend into the interior region of the waste-collection bowl to overlap and lie within the brim of the waste-collection bowl and to locate the brim of the waste-collection bowl in an annular space provided between the border edge of the top wall of the base and the downwardly extending liquid-deflection rim of the juvenile trainer seat, and the seat pads of the juvenile trainer seat and the seat topper are arranged to lie in a space provided between the lid and the top wall of the base when the lid is moved to assume the closed position on the base, wherein the juvenile trainer seat further includes a urine deflector coupled to the seat pad of the juvenile trainer seat and arranged to extend upwardly away from the downwardly extending liquid-deflection rim of the juvenile trainer seat, the seat topper further includes a urine deflector coupled to the seat pad of the seat topper and arranged to extend upwardly away from the downwardly extending liquid-deflection rim of the seat topper, the urine deflector of the seat topper is formed to include a downwardly opening deflector-receiving space, and the urine deflector of the juvenile seat trainer is arranged to extend upwardly into the downwardly opening deflector-receiving space formed in the urine deflector of the seat topper to lie in a mated, nested relation to the urine deflector of the seat topper when the seat pad of the seat topper is mounted on the seat pad of the juvenile trainer seat.

9. The juvenile potty system of claim 8, wherein the juvenile trainer seat further includes positioning arms that are coupled to and extend below the seat pad of the juvenile trainer seat to align with and extend into companion arm-receiver holes formed in the base when the juvenile trainer seat is mounted on the base.

10. The juvenile potty system of claim 9, wherein the lid is sized and configured to cover the juvenile trainer seat and the seat topper completely when the lid is closed to mate with the base.

11. A juvenile potty system comprising a waste-collection bowl formed to include an interior region, a juvenile seat trainer including a trainer seat pad formed to include a central aperture opening into the interior region when the juvenile seat trainer is mounted on the waste-collection bowl and a downwardly extending liquid-deflection rim arranged to extend into the interior region of the waste receptacle bowl, a seat topper mounted on the juvenile seat trainer to trap the juvenile seat trainer in a predetermined position between the waste-receptacle bowl and the seat topper, the seat topper including a topper seat pad formed to include a central aperture opening into the interior region when the seat topper is mounted on the juvenile seat trainer and a downwardly extending liquid-deflection rim arranged to extend into the interior region of the waste-receptacle bowl and to overlap and lie within the lid-deflection rim of the juvenile trainer seat, wherein the waste-collection bowl includes a waste receptacle formed to include the interior region and a seat receiver arranged to extend around the waste receptacle and the trainer seat pad is configured to mate with the seat receiver of the waste-collection bowl to support the juvenile seat trainer on the waste-collection bowl to cause the liquid-deflection rim of the juvenile seat trainer to extend into the interior region formed in the waste receptacle, wherein the seat receiver includes a lip that is tapered down into the waste receptacle to force any excess liquid splatter to run back into the interior region of the waste receptacle, wherein the juvenile seat trainer further includes a urine deflector coupled to the trainer seat pad in alignment with the lip of the seat receiver to overlie the lip of the seat receiver, and wherein the seat topper further includes a urine deflector coupled to the topper seat pad and the urine deflector of the juvenile training seat is arranged to extend upwardly into a downwardly opening deflector-receiving space formed in the urine deflector of the seat topper to lie in mated, nested relation to the urine deflector of the seat topper when the topper seat pad is mounted on the trainer seat pad.

* * * * *